US007987519B1

(12) United States Patent
Raso

(10) Patent No.: US 7,987,519 B1
(45) Date of Patent: Aug. 2, 2011

(54) DISPOSABLE INFANT BIB

(76) Inventor: Phyllis Raso, Lindenhurst, NY (US)

( * ) Notice: Subject to any disclaimer, the term of this patent is extended or adjusted under 35 U.S.C. 154(b) by 0 days.

(21) Appl. No.: 12/814,928

(22) Filed: Jun. 14, 2010

Related U.S. Application Data

(60) Provisional application No. 61/187,163, filed on Jun. 15, 2009.

(51) Int. Cl.
*A41B 13/10* (2006.01)

(52) U.S. Cl. ..... 2/49.1

(58) Field of Classification Search ..... 2/48, 49.1–49.5, 2/50, 51, 52, 88, 91, 102, 104, 75, 69.5, 92, 2/114, 111; D2/861
See application file for complete search history.

(56) References Cited

U.S. PATENT DOCUMENTS

| | | | | | |
|---|---|---|---|---|---|
| 1,003,489 | A * | 9/1911 | Moritz | 2/50 |
| 1,701,929 | A * | 2/1929 | Mettam | 2/83 |
| 2,154,227 | A * | 4/1939 | Brown | 2/74 |
| 2,451,038 | A * | 10/1948 | Mink | 2/48 |
| 2,688,750 | A * | 9/1954 | Mink | 2/49.3 |
| 4,733,411 | A * | 3/1988 | Foti | 2/49.1 |
| 4,987,612 | A * | 1/1991 | Middleton | 2/104 |
| 5,034,999 | A * | 7/1991 | Lubbers | 2/104 |
| 5,418,979 | A | 5/1995 | Senderowicz | |
| 5,682,609 | A * | 11/1997 | Ayo | 2/49.2 |
| 5,930,836 | A | 8/1999 | Morris | |
| 6,049,909 | A | 4/2000 | Anderson | |
| 6,282,716 | B1 | 9/2001 | Patterson et al. | |
| 6,349,411 | B1 * | 2/2002 | Tyler | 2/69 |
| 6,415,442 | B1 | 7/2002 | Smith | |
| 6,532,595 | B1 | 3/2003 | Holmes | |
| 7,237,271 | B1 | 7/2007 | McLandrich | |
| 7,490,362 | B2 * | 2/2009 | Owen | 2/104 |
| 7,716,749 | B2 * | 5/2010 | Perazzo | 2/49.1 |

* cited by examiner

*Primary Examiner* — Amy B Vanatta
(74) *Attorney, Agent, or Firm* — Crossley Patent Law; Mark A. Crossley

(57) ABSTRACT

A disposable infant bib including a thin one-piece body formed of a waterproof outer layer and a biodegradable paper inner layer fixedly attached thereto via an adhesive layer therebetween. A pair of horizontally-aligned spaced apart oval apertures, each having a continuous reinforced edge, is centrally disposed in the body to removably receive an infant's arms therethrough. A band is attached to a body upper side. Hook and loop fastener first and second attachment bodies disposed on each end of the band releasably attach together to completely secure the band around an entire infant's neck and sits high upon the infant's neck and the body has a length which stretches from an upper end of an infant's neck to proximal to the infant's knees thereby preventing spillage onto an infant's clothes.

5 Claims, 3 Drawing Sheets

DISPOSABLE INFANT BIB

CROSS-REFERENCE TO RELATED APPLICATIONS

U.S. Provisional Application No. 61/187,163 filed on Jun. 15, 2009

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of infant bibs are known in the prior art. However, what is needed is a disposable infant bib including a thin one-piece body formed of a waterproof outer layer and a biodegradable paper inner layer fixedly attached thereto via an adhesive layer therebetween. A pair of horizontally-aligned spaced apart oval apertures having a continuous reinforced edge is centrally disposed through the body to removably receive an infant's arms therethrough. A thin band is continuously attached to a body upper side. Hook and loop fastener first and second attachment bodies disposed on each end of the band releasably attach together to completely secure the band around an entire infant's neck and sits high upon the infant's neck and the body has a length which stretches from an upper end of an infant's neck to proximal to the infant's knees thereby preventing spillage onto an infant's clothes.

FIELD OF THE INVENTION

The present invention relates to infant bibs, and more particularly, to a disposable infant bib including a body having a waterproof outer layer and a biodegradable paper inner layer fixedly attached thereto via an adhesive layer therebetween as well as a thin band continuously attached to a body upper side, each end of the band secured together with hook and loop fastener first and second attachment bodies that completely secure the band around an entire infant's neck high upon the infant's neck to prevent spillage onto an infant's clothes.

SUMMARY OF THE INVENTION

The general purpose of the present disposable infant bib, described subsequently in greater detail, is to provide a disposable infant bib which has many novel features that result in a disposable infant bib which is not anticipated, rendered obvious, suggested, or even implied by prior art, either alone or in combination thereof.

To accomplish this, the present disposable infant bib includes a thin one-piece body formed of a waterproof outer layer, a biodegradable paper inner layer fixedly attached to the outer layer, and an adhesive layer disposed between and attaching the outer layer and the inner layer together. A pair of horizontally-aligned spaced apart apertures is centrally disposed proximal to the upper side to removably receive a pair of an infant's arms therethrough. Each of the apertures may be oval shaped thus permitting more arm upward and downward movement within each of the apertures than if the apertures were another shape, such as circular.

A band, having a first side and a second side, is attached to the upper side of the body in a position parallel to the upper side. A hook and loop fastener first attachment body secured to the first side proximal to a band first outer end releasably attaches to a hook and loop fastener second attachment body extended outwardly from the second side proximal to a band second outer end of the band. The band removably completely secures around an entire infant's neck and sits high upon the infant's neck to prevent spillage onto an infant's clothing through the neck area, which may otherwise occur if the neck were more open and rested in a lower position over an infant's clothes.

The maximum length of the body, measured from the upper side to the lower side, permits the body to fit from an upper end of an infant's neck to a position proximal to an infant's knees thus also preventing spillage onto the infant's clothes. The maximum width of the body 20, as measured from the left side 22 to the right side 24, permits the body 20 to wrap substantially around an infant's torso which also prevents spillage onto the infant's clothes.

In addition, the outer layer may bear various indicia, colors, and patterns to enhance the appearance of the bib, to make the bib more enticing to wear by an infant, and to provide entertainment to an infant.

Thus has been broadly outlined the more important features of the present disposable infant bib so that the detailed description thereof that follows may be better understood and in order that the present contribution to the art may be better appreciated.

Numerous objects, features and advantages of the present disposable infant bib will be readily apparent to those of ordinary skill in the art upon reading the following detailed description of presently preferred, but nonetheless illustrative, examples of the present disposable infant bib when taken in conjunction with the accompanying drawings. In this respect, before explaining the current examples of the present disposable infant bib in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the disposable infant bib. It is therefore important that the claims be regarded as including such equivalent constructions insofar as they do not depart from the spirit and scope of the present invention.

Objects of the present disposable infant bib, along with various novel features that characterize the invention are particularly pointed out in the claims forming a part of this disclosure. For better understanding of the disposable infant bib, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
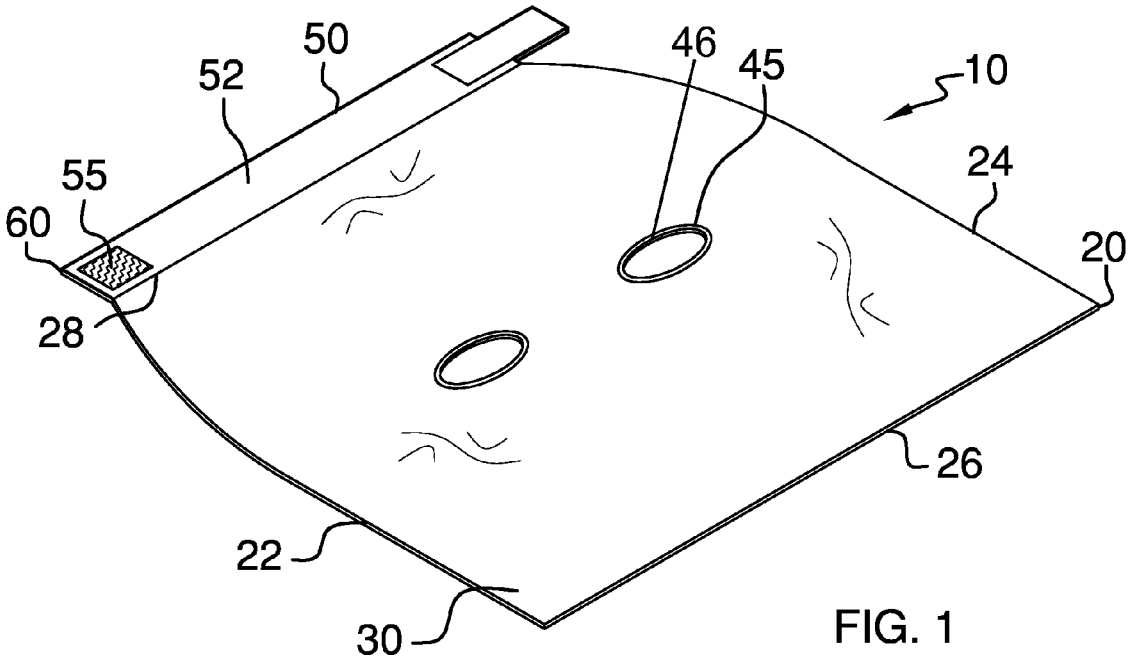
FIG. 1 is an isometric top view.
Figure 2:
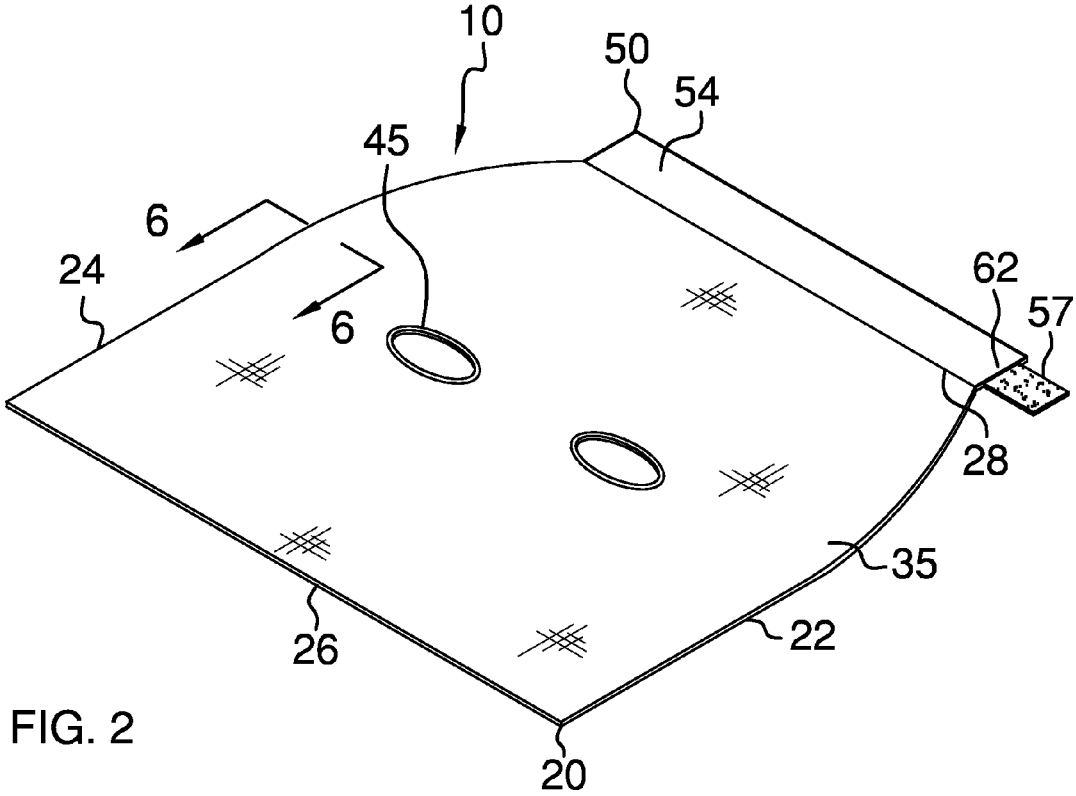
FIG. 2 is an isometric bottom view.
Figure 3:
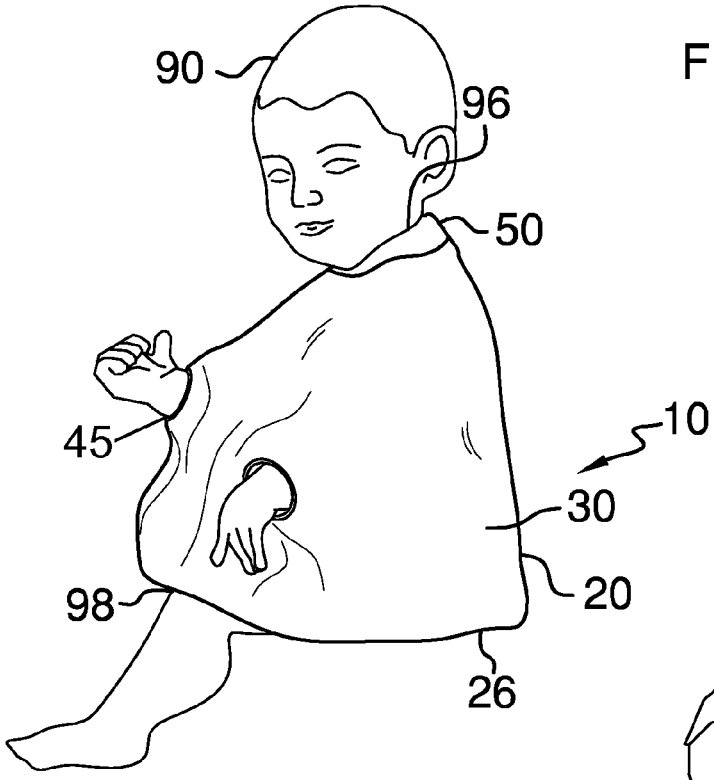
FIG. 3 is an in-use right elevation view, with the opposite side being a mirror image of the shown.
Figure 4:
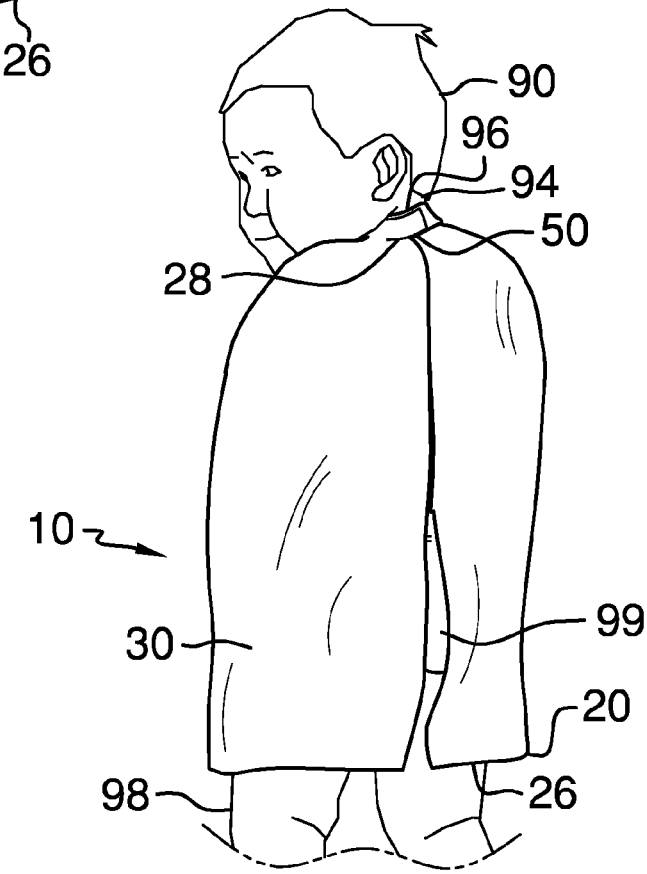
FIG. 4 is an in-use rear elevation view.
Figure 5:
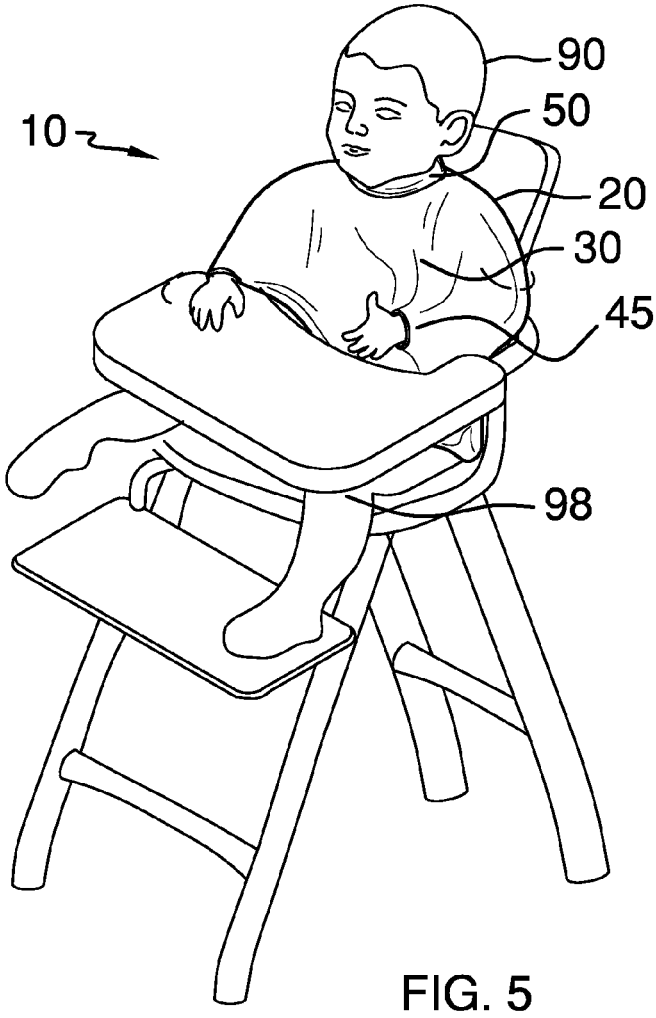
FIG. 5 is an in-use isometric view.
Figure 6:
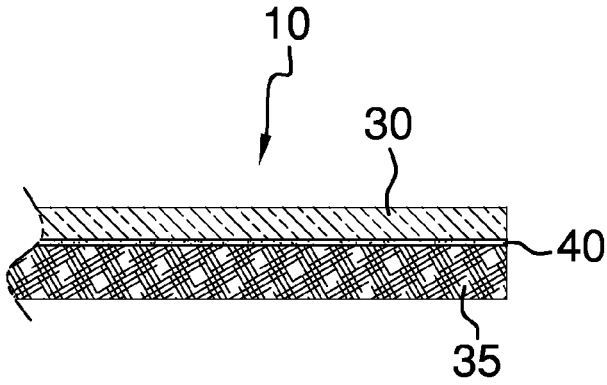
FIG. 6 is a cross-section view taken along lines 6-6 of FIG. 2.

With reference now to the drawings, and in particular FIGS. 1 through 6 thereof, example of the instant disposable infant bib employing the principles and concepts of the present disposable infant bib and generally designated by the reference number 10 will be described.

Referring to FIGS. 1 through 6 a preferred embodiment of the present disposable infant bib 10 is illustrated. The disposable infant bib 10 includes a thin one-piece body 20. The body 20 has a left side 22, a right side 24 disposed opposite the left side 22, a lower side 26, and an upper side 28 disposed parallel to the opposite lower side 26. In addition, the body 20 is formed of a waterproof outer layer 30, a biodegradable paper inner layer 35 fixedly attached to the outer layer 30, and an adhesive layer 40 disposed between the outer layer 30 and the inner layer 35. The adhesive layer 40 attaches the inner layer 35 to the outer layer 30.

A pair of horizontally-aligned spaced apart apertures 45 is centrally disposed in the body 20 along a horizontal midline of the body 20. Each of the apertures 45 has a continuous reinforced edge 46. The apertures 45 removably receive a pair of an infant's 90 arms 92 therethrough. Each of the apertures 45 may be oval shaped as illustrated. The oval shape of the apertures 45 permits more arm upward and downward movement within each of the apertures 45 than if the apertures 45 were another shape, such as circular.

A band 50 is attached to the upper side 28 of the body 20 in a position parallel to the upper side 28. The band 50 has a first side 52 and a second side 54. A hook and loop fastener first attachment body 55 is secured to the first side 52 proximal to a first outer end 60 of the band 50. A hook and loop fastener second attachment body 57 extends outwardly from the second side 54 proximal to a second outer end 62 of the band 50. The second attachment body 20 releasably secured to the first attachment body 55. The band 50 removably completely secures around an entire infant's 90 neck 94 during securement of the second attachment body 57 to the first attachment body 55.

The maximum length of the body 20, measured from the upper side 28 to the lower side 26, permits the body 20 to fit from an upper end 96 of an infant's 90 neck 94 to a position proximal to an infant's 90 knees 98. The maximum width of the body 20, as measured from the left side 22 to the right side 24, permits the body 20 to wrap substantially around an infant's torso.

Use:

The present disposable infant bib 10 described herein and illustrated in the drawings is used to protect an infant's 90 clothes from getting soiled. To utilize the present bib 10, the user selects an appropriate body 20 length which permits the body 20 to fit from an upper end 96 of the infant's 90 neck 94 to a position proximal to the infant's 90 knees 98. The user removably inserts each of an infant's 90 arms 92 through each of the pair of apertures 45 with the upper side 28 of the body 20 disposed at the upper end 96 of the infant's 90 neck 94. The user then wraps the band 50 around the infant's neck 94 and secures the first attachment body 55 to the second attachment body 57. If the infant 90 is seated while wearing the bib 10, the user ensures that the body 20 is stretched out over the infant 90 so that the bib covers the infant's 90 clothes 99 from the upper end 96 of the infant's neck 94 to a point proximal to the infant's 90 knees 98.

With respect to the above description then, it is to be realized that the optimum dimensional relationships for the parts of the present disposable infant bib to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A disposable infant bib comprising:

a thin one-piece body, the body comprising:

a left side;

a right side disposed opposite the left side;

a lower side;

an upper side disposed parallel to the opposite lower side;

a waterproof outer layer;

a biodegradable paper inner layer fixedly attached to the outer layer;

an adhesive layer disposed between the outer layer and the inner layer wherein the adhesive layer attaches the inner layer to the outer layer;

a pair of horizontally-aligned spaced apart apertures centrally disposed in the body along a horizontal midline of the body, each of the apertures having a continuous reinforced edge, wherein the apertures removably receiving a pair of an infant's arms therethrough;

a band attached to the upper side in a position parallel to the upper side, the band having a first side and a second side;

a hook and loop fastener first attachment body secured to the first side proximal to a first outer end of the band;

a hook and loop fastener second attachment body extended outwardly from the second side proximal to a second outer end of the band, the second attachment body releasably secured to the first attachment body;

wherein the band removably completely secures around an entire infant's neck during securement of the second attachment body to the first attachment body.

2. The disposable infant bib of claim 1 wherein the body is configured to cover an infant's knees.

3. The disposable infant bib of claim 2 wherein the body is configured to completely wrap around an infant's torso.

4. The disposable infant bib of claim 3 wherein each of the apertures is oval shaped.

5. The disposable infant bib of claim 4 wherein the outer layer is formed of plastic.

* * * * *